US007934493B1

(12) United States Patent
Maruyama

(10) Patent No.: US 7,934,493 B1
(45) Date of Patent: May 3, 2011

(54) SELF-LOADING BOLT ASSEMBLY FOR AIRGUNS

(76) Inventor: Tadaaki Maruyama, Chiba (JP)

( * ) Notice: Subject to any disclaimer, the term of this patent is extended or adjusted under 35 U.S.C. 154(b) by 59 days.

(21) Appl. No.: 12/588,572

(22) Filed: Oct. 20, 2009

(51) Int. Cl.
*F41B 11/00* (2006.01)

(52) U.S. Cl. ..... 124/73; 124/72; 124/74; 124/76

(58) Field of Classification Search ..... 124/71–77
See application file for complete search history.

(56) References Cited

U.S. PATENT DOCUMENTS 3,572,310 A * 3/1971 Chiba ..... 124/76
4,770,153 A * 9/1988 Edelman ..... 124/72
5,383,442 A * 1/1995 Tippmann ..... 124/76
5,778,868 A * 7/1998 Shepherd ..... 124/76
6,601,780 B1 * 8/2003 Sheng ..... 239/337
7,712,463 B2 * 5/2010 Quinn et al. ..... 124/73
7,735,479 B1 * 6/2010 Quinn et al. ..... 124/73
2007/0028909 A1 * 2/2007 Wood ..... 124/73
2009/0178661 A1 * 7/2009 Wood ..... 124/73

* cited by examiner

*Primary Examiner* — Troy Chambers

(57) ABSTRACT

Since a conventional self-loading bolt assembly for airguns is complicated in construction, the cost of its production comes expensive.

A simple piston-cylinder mechanism was found to decrease a component count of the self-loading bolt assembly. Since the present invention remarkably decreases the component count, the cost of the production of the assembly is drastically decreased with striking success.

1 Claim, 1 Drawing Sheet

SELF-LOADING BOLT ASSEMBLY FOR AIRGUNS

TECHNICAL FIELD OF THE INVENTION

The present invention relates to a self-loading bolt assembly for an airgun operated by means of compressed gas, wherein a bomb incorporated in the airgun delivers the compressed gas.

BACKGROUND ARTS

Most of the sniper rifles employ a manual bolt. A shooter manually operates the bolt when a bullet is loaded into a powder chamber of the barrel. The operation of the manual bolt is automated using pressure of the compressed gas, so that the shooter's loading effort of the assembly is lessened. One of the self-loading bolt assemblies for an airgun is disclosed in U.S. Pat. No. 3,572,310 (which is issued on Mar. 23, 1971 to Mr. Chiba). As shown in FIG. 5 of the drawings in this patent, a defect in the conventional self-loading bolt assembly for the airgun resides in its complicated construction. The conventional assembly disadvantageously requires many components, and also requires a "strong firing spring 34" as disclosed in line 36 on column 3 of the patent. Due to the existence of this strong firing spring, when the bullet is fired, a strong reaction follows. This is another defect of the conventional assembly for the airgun.

SUMMARY OF THE INVENTION

Problem to be Solved by the Invention

As described above, the conventional self-loading bolt assembly for the airgun has a fatal defect in the fact that the firing of the bullet follows such a strong reaction.

It is an object of the present invention to provide a self-loading bolt assembly for an airgun in order to solve the above defect by providing the self-loading bolt assembly which is simple in construction and in which a reaction of firing of the bullet is extremely low.

Means for Solving the Problem

In order to accomplish the above object, the present invention provides a self-loading bolt assembly essentially constructed of only three components: that is, a cylinder coaxially formed in a breech portion of a barrel;

a hollow piston coaxially and loosely-fitted in the cylinder so as to be axially movable relative to the cylinder; and, a firing pin coaxially incorporated in the hollow piston so as to be axially movable relative to the hollow piston.

EFFECT OF THE INVENTION

As described above, the self-loading bolt assembly of the present invention is constructed of only three components. Further, individual components of the assembly are simple in construction. Consequently, the self-loading bolt assembly of the present invention is capable of being manufactured at low cost with respect to its individual components. These components are easy in assembly.

PREFERRED EMBODIMENT OF THE INVENTION

Hereinbelow, with reference to the accompanying drawing, an embodiment of the present invention will be described.

As shown in FIG. 1, the self-loading bolt assembly of the present invention is essentially constructed of three components in total, that is: a cylinder 10 formed in a breech portion of a barrel 2 so as to be coaxial with the barrel 2; a hollow piston 6 coaxially formed in the cylinder 10 and loosely-fitted in the cylinder 10 so as to be axially movable relative to the cylinder 10; and, a firing pin 9 coaxially incorporated in the hollow piston 6 so as to be axially movable relative to the hollow piston 6.

As shown in FIG. 1, the airgun of the present invention is constructed of the barrel 2; the self-loading bolt assembly (6, 9, 10) incorporated in the barrel 2; a magazine 15; and, a trigger 13.

The magazine 15 has a construction for receiving a plurality of bullets 1 inside the magazine 15. The construction is disclosed in detail in U.S. Pat. No. 3,572,310. All the disclosure of this U.S. patent is incorporated in both the specification and drawing of the present invention herein by reference.

The magazine 15 receives a plurality of bullets 1 inside the magazine 15. The plurality of bullets 1 are lined inside the magazine 15 and disposed on a bullet support. The support is resiliently biased upward by a compression coil spring thereby delivering the bullet 1 upward. As shown in FIG. 1, the magazine 15 is snapped in a magazine-receiving portion of the barrel 2.

In a state of FIG. 1, the self-loading bolt assembly (6, 9, 10) receives the compressed gas through an inlet 14, to which the compressed gas of a bomb (not shown) is supplied. This compressed gas thus supplied is then delivered to the cylinder 10. When the compressed gas is delivered to the cylinder 10, the compressed gas acts on the hollow piston 6 so as to move back or retract the hollow piston 6 to its retracted position in a direction toward the trigger 13. Shown in phantom lines in this retracted position is a rear large-diameter portion of the hollow piston 6. Incidentally, the hollow piston 6 is a component generally so-called "bolt".

When the hollow piston 6 is retracted to its retracted position, a front small-diameter portion 3 of the hollow piston 6 opens an upper opening portion of the magazine 15. Then, the bullet 1 in the uppermost position of the magazine 15 enters the barrel 2.

On the other hand, when the hollow piston 6 is moved back to its retracted position, a clearance 11 between the rear large-diameter portion of the cylinder 10 and the rear large-diameter portion of the hollow piston 6 is enlarged. Consequently, as is clear from FIG. 1, the pressure of the compressed gas flows back into a rear compressed-gas receiving portion 5 of the hollow piston 6. When this happens, the pressure of the compressed gas flowing back into the rear compressed-gas receiving portion 5 of the hollow piston 6 acts on the hollow piston 6, so that the hollow piston 6 is moved forward in the reverse direction opposite to the direction toward the trigger 13 thereby moving the bullet 1 forward up to its firing position in the powder chamber of the barrel 2. The firing position of the bullet 1 is shown in FIG. 1. A first O-ring O1 is fitted in a rear wall of the cylinder 10 to seal an outer periphery of a rear large-diameter portion of the firing pin 9. A second O-ring O2 is fitted in a front wall of the cylinder 10 to seal an outer periphery of the front small-diameter portion of the hollow piston 6. A third O-ring O3 is fitted in a firing-pin receiving portion 4 of the hollow piston 6 to seal an outer periphery of a front small-diameter portion of the firing pin 9. An fourth O-ring O4 is fitted in an inner-wall portion of the barrel 2 to seal an outer periphery of the front small-diameter portion 3 of the hollow piston 6.

After the bullet 1 is disposed in its firing position shown in FIG. 1 as described above, when the trigger 13 is pulled by a shooter, the firing pin 9 is released from the trigger 13 so that the firing pin 9 is rapidly retracted relative to the hollow piston 6 by means of the pressure of the compressed gas acting on the rear large-diameter shoulder portion 12 of the firing pin 9 thereby opening the opening portion of the third O-ring O3. When the opening portion of the third O-ring O3 is opened, the pressure of the compressed gas having been filled in the cylinder 10 ejects onto the rear surface of the bullet 1 in the barrel 2 through the opening portion of the third O-ring O3.

When the bullet 1 in the barrel 2 is fired outward from the muzzle of the barrel 2 in this way by means of the pressure of the compressed gas, the pressure inside the barrel 2 also rapidly drops to the atmospheric pressure. Naturally, the pressure inside the cylinder 10 communicating with barrel 2 also rapidly drops. Then, new compressed gas from the bomb (not shown) is supplied into the cylinder 10 through the intake 14.

On the other hand, the firing pin 9 having been retracted by the pressure of the compressed gas compresses a return spring provided in a rear portion of the firing pin 9. The firing pin 9 is then moved forward by a restoring force of the return spring thus compressed, thereby causing the firing pin 9 to be engaged again with the trigger 13. At this time, as is clear from FIG. 1, the trigger 13 has its front nail portion urged upward by a restoring force of a return spring provided under the front nail portion of the trigger 13, thereby causing the front nail portion of the trigger 13 to be engaged again with the firing pin 9 at its concave portion. Consequently, as shown in FIG. 1, the trigger 13 having been engaged with the firing pin 9 prevents the firing pin 9 from moving backward even when the rear large-diameter shoulder portion 12 of the firing pin 9 is subjected to a pressure of a newly-applied compressed gas, thereby keeping the firing pin 9 at its firing-effective position.

After that, the trigger 13 is pulled by a shooter to fire the bullet 1 in the barrel 2. When the bullet 1 is fired so that the bullet 1 is ejected outward from the muzzle of the barrel 2 by means of the pressure of the compressed gas, a new compressed gas is supplied from the bomb (not shown) into the cylinder 10 through the intake 14. Consequently, the hollow piston 6 is moved backward by means of the pressure of the compressed gas in a direction toward the trigger 13 to reach its retracted position as shown in phantom lines in FIG. 1.

When the hollow piston 6 reaches its retracted position, the clearance 11 between the rear large-diameter portion of the cylinder 10 and the hollow piston 6 is enlarged. Consequently, this enlarged clearance 11 permits the pressure of the compressed gas to flow into a rear compressed-gas receiving portion 5 of the hollow piston 6. When this happens, the hollow piston 6 receives the pressure of the compressed gas flowing into the compressed-gas receiving portion 5 of the hollow piston 6, thereby forcing the hollow piston 6 to move forward in the barrel 2 in a direction opposite to a direction toward the trigger 13 so that the bullet 1 inside the magazine 15 advances to its firing position inside the powder chamber of the barrel 2. This firing position of the bullet 1 is shown in FIG. 1.

When the hollow piston 6 is moved forward in the direction toward the muzzle of the barrel 2, an air confined between a front wall of the cylinder 10 and the hollow piston 6 is compressed. However, since the hollow piston 6 is loosely-fitted in the cylinder 10, such compressed air may escape to a space behind the hollow piston 6 through the clearance 11 between the hollow piston 6 and the cylinder 10. Due to this, the air compressed between the front wall of the cylinder 10 and the hollow piston 6 does not prevent the forward movement of the hollow piston 6 relative to the cylinder 10 in a direction toward the muzzle of the barrel 2.

As described above, the loading operation of the bullet 1 from a first bullet position to a subsequent bullet position in the self-loading bolt assembly of the present invention is completed without any trouble. As a result, the present invention enables a shooter to concentrate his energies only on his shooting effort until the magazine 15 is exhausted.

DESCRIPTION OF THE REFERENCE NUMERALS

Figure 1:
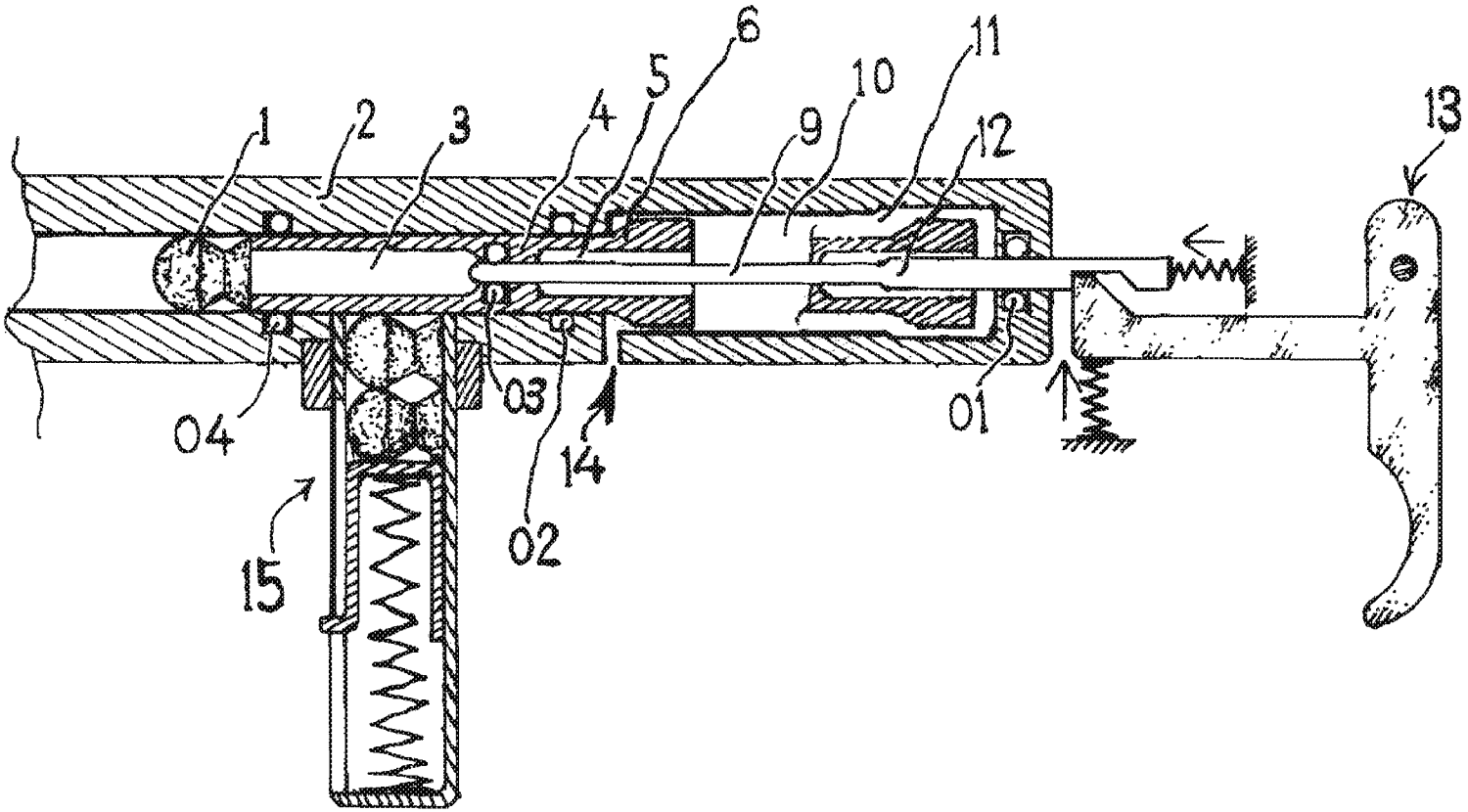
FIG. 1 A central longitudinal cross-sectional view of the self-loading bolt assembly for the airgun illustrated by the embodiment of the present invention.

1 the bullet;
2 the barrel;
3 the front small-diameter portion of the hollow piston;
4 the firing-pin receiving portion of the hollow piston;
5 the rear compressed-gas receiving portion of the hollow piston;
6 the hollow piston;
10 the cylinder;
11 the clearance between the cylinder and the hollow piston;
12 the rear large-diameter shoulder portion of the firing pin;
13 the trigger;
14 the intake;
15 the magazine;
O1 the first O-ring fitted in the rear wall of the cylinder for sealing the outer periphery of the rear large-diameter portion of the firing pin;
O2 the second O-ring fitted in the front wall of the cylinder;
O3 the third O-ring fitted in the firing-pin receiving portion of the hollow piston to seal the outer periphery of the front small-diameter portion of the firing pin; and,
O4 the fourth O-ring fitted in the inner wall portion of the barrel to seal the outer periphery of the front small-diameter portion of the hollow piston disposed in its forward position.

The invention claimed is:

1. A self-loading bolt assembly (6, 9, 10) for an air gun comprising: a cylinder (10) formed coaxially in a breech portion of a barrel (2); a hollow piston (6) coaxially loosely-fitted in the cylinder (10) so as to be movable relative to the cylinder (10); and, a firing pin (9) coaxially incorporated into the hollow piston (6) so as to be movable relative to the hollow piston (6);

wherein the cylinder (10) assumes a tubular shape constructed of a front small-diameter portion and a rear large-diameter portion, the hollow piston (6) is loosely-fitted in the cylinder (10) so as to be axially movable relative to the cylinder (10), a clearance (11) between the cylinder (10) and the hollow piston (6) is enlarged when the hollow piston (6) has its rear portion entered the rear large-diameter portion of the cylinder (10) to permit a compressed gas to readily enter a compressed-gas receiving portion (5) of the rear portion of the hollow piston (6) through the clearance (11) thus enlarged so that hollow piston (6) is driven forward toward a muzzle of the barrel (2) thereby forcing a bullet (1) to be positioned in a predetermined firing position in a powder chamber of the barrel (2), wherein the firing pin (9) assumes a rod-like form and receives the pressure of the compressed gas at its rear large-diameter shoulder portion (12) to move rearward in the reverse direction opposite to the direction toward the muzzle of the barrel (2) thereby forcing an opening portion of a third O-ring (O3) clogged with the firing pin (9) to open so as to spout a jet of the compressed gas toward a rear surface of the bullet (1) to propel the bullet (1) forward, wherein air confined between a front wall of the cylinder (10) and the hollow piston (6) loosely-fitted in the cylinder (10) is compressed when the hollow piston (6) moves forward relative to the cylinder (10) so that the air thus compressed escapes through the clearance (11) between the hollow piston (6) and the cylinder (10) toward the rear of the hollow piston (6), thereby preventing the air thus compressed from disturbing forward motion of the hollow piston (6) relative to the cylinder (10).

* * * * *